United States Patent [19]

Hilliard

[11] 4,364,407

[45] Dec. 21, 1982

[54] MUD SAVER VALVE

[76] Inventor: David R. Hilliard, P.O. Box 15036, Baton Rouge, La. 70895

[21] Appl. No.: 237,248

[22] Filed: Feb. 23, 1981

[51] Int. Cl.[3] ..... E21B 7/00

[52] U.S. Cl. ..... 137/71; 137/493.2; 137/515.5; 166/317; 166/325; 175/218

[58] Field of Search ..... 137/71, 493.1, 493.2, 137/493.3, 493.4, 493.5, 493.6, 515, 515.5; 166/317, 325; 175/218

[56] References Cited

U.S. PATENT DOCUMENTS

| | | | |
|---|---|---|---|
| 2,673,062 | 3/1954 | Cornelius | 137/540 |
| 3,331,385 | 7/1967 | Taylor | 137/493.6 |
| 3,698,411 | 10/1972 | Garrett | 137/493.1 X |
| 3,738,436 | 6/1973 | Litchfield | 175/218 X |
| 3,965,980 | 6/1976 | Williamson | 175/218 X |
| 3,967,679 | 7/1976 | Lihjestrand | 175/218 X |
| 4,128,108 | 12/1978 | Parker | 137/493.9 |

*Primary Examiner*—Robert G. Nilson

*Attorney, Agent, or Firm*—Guy E. Matthews

[57] ABSTRACT

Disclosed is a mud saver valve which includes a tubular body connectable between a kelly and a drill string. An annular seat ring having a central opening is mounted within the body. A piston is axially movably mounted within the body for engagement with the seat ring. The piston includes a bore substantially coaxially aligned with the central opening and a flange that extends radially outwardly from the piston to slidingly engage the interior of the body. The piston has a plurality of ports above the piston to communicate the exterior of the piston with the bore. A plug is removably mounted in the piston. The plug includes a shear ring removably inserted in the bore and a spear axially movably mounted in the shear ring. The plug is movable between a first position wherein the spear sealingly engages the shear ring in a second position that allows fluid to flow upwardly between the spear and the shear ring. A spring is provided to urge the piston into engagement with the seat ring.

10 Claims, 5 Drawing Figures

MUD SAVER VALVE

A. BACKGROUND OF THE INVENTION

This invention relates generally to valves, and more particularly to a valve for preventing the loss of drilling mud when the kelly is disconnected from the drill pipe.

B. DESCRIPTION OF THE PRIOR ART

During the drilling of oil and gas wells, it is necessary to disconnect the kelly from the drill string each time additional stands of drill pipe are added to the string. Since the kelly is normally filled with drilling mud, it is desirable to insert between the kelly and the drill string a valve that will allow mud to flow through the kelly and drill string during drilling, but will automatically close when the mud pumps are deactuated and the kelly is disconnected from the drill string. Such valves are commonly referred to as mud saver valves and are illustrated in the following patents: Parker et al U.S. Pat. No. 4,128,108; Liljestrand U.S. Pat. No. ,3,967,679; Williamson U.S. Pat. No. 3,965,980; Litchfield et al, U.S. Pat. No. 3,738,436; Garrett U.S. Pat. No. 3,698,411; and Taylor U.S. Pat. No. 3,331,385.

All of the foregoing patents disclose valves that include a seat, a closure member and means for urging the closure member into engagement with the seat. Additionally, all of the foregoing patents disclosed valves in which the closure member may be removed or otherwised eliminated in order that fishing tools may be run through the valves. Also, most of the foregoing patents disclose valves having some capability to allow back flow of drilling mud to read or bleed off down hole pressure.

Each of the valves of the prior art have certain shortcoming. The primary shortcomings of all of such valves lies in their lack of wear resistance. Drilling mud is a highly erosive fluid that is pumped through the kelly and into the drill string at high flow rates. All of the valves of the prior art are subject to extreme wear due to the turbulent flow of drilling mud therethrough. The turbulence is caused by a the combination of the high flow rate through the valves and the sharp changes in direction and size of flow passages that the mud must undergo in flowing through such valves.

A further shortcoming of most of the mud saver valves of the prior art is in their ability to handle back flow. In certain situations, because of pipe stretch are the compressibility of gas cut mud, considerable quantities of mud must be bled back before the kelly is disconnected from the drill string. In most of the mud saver valves of the prior art, the passage through which back flow may occur is so small that substantial periods of time are required in order to bleed down the pressure in the string.

It is therefore an object of the present invention to provide a mud saver valve which overcomes the shortcomings of the prior art. It is a further object of the present invention to provide a mud saver valve that is less subject to wear and washing out than the mud saver valves of the prior art. It is yet a further object of the present invention to provide a mud saver valve with improved back flow capabilities.

SUMMARY OF THE INVENTION

Briefly stated, the foregoing and other objects of the present invention are accomplished by providing a valve that includes tubular body connectable between the kelly and the drill string. An annular seat ring having a central opening is mounted within the body. A piston is axially movably disposed with the body for engagement within the seat ring. The piston includes a bore substantially coaxially aligned with the central opening of the seat ring and a flange extending radially outwardly from the piston to slidingly engage the interior of the body. The piston includes a plurality of ports above the piston communicating the exterior of the piston with the bore. A plug is removably mounted in the piston above the port to normally close the bore. The plug includes a shear ring removably inserted in the bore and a spear axially movably mounted within the shear ring and movable between a first position wherein the spear sealingly engages the shear ring and a second position wherein fluid may flow upwardly between the spear and the shear ring. A spring is provided to urge the piston into engagement with the seat ring.

BRIEF DESCRIPTIONS OF THE DRAWINGS

DESCRIPTION OF THE PREFERRED EMBODIMENT

Figure 1:
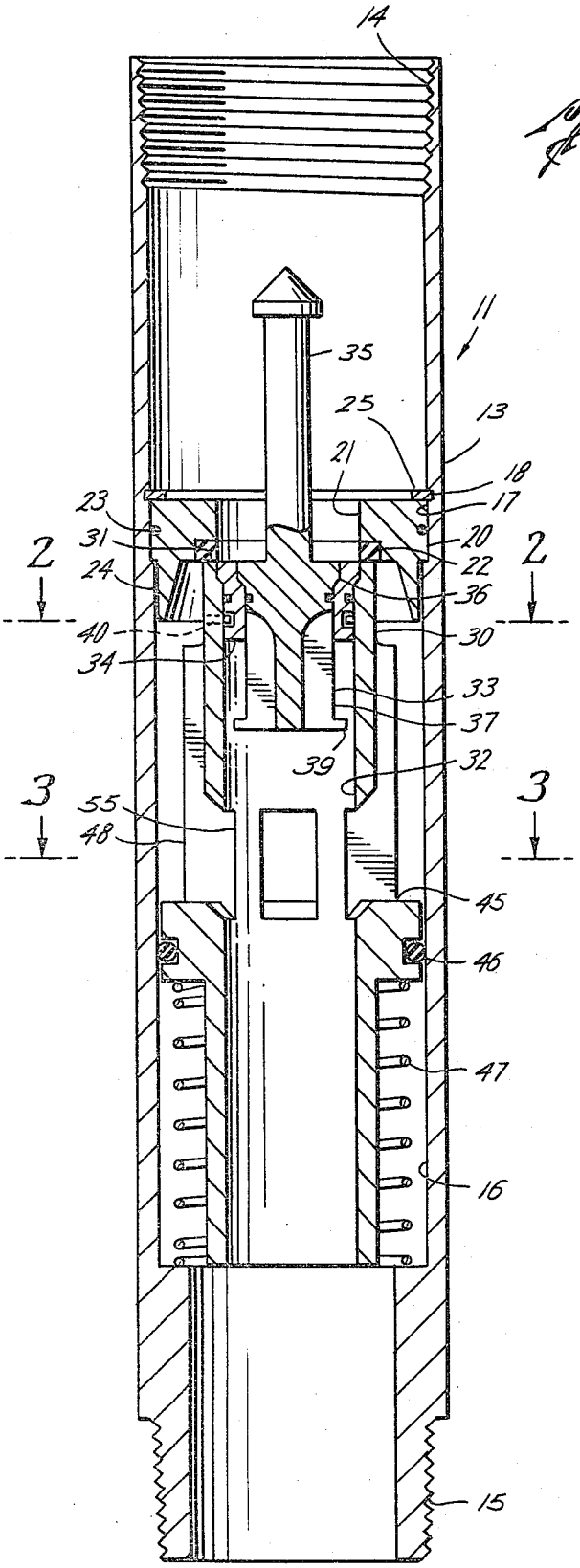
FIG. 1 is a section view of the mud saver valve of the present invention.

Referring now to the drawings, and first to FIG. 1, the mud saver valve of the present invention is designated by the numeral 11 and includes generally a tubular body 13, a seat ring 20, and a piston 30. Body 11 includes a box 14 which is connectable to a kelly (not shown) and a pin 15 which is connectable with a drill pipe joint (not shown). Body 13 is machined to form an annular piston recess 16 and an annular seat ring recess 17. Body 13 also includes an annular snap ring recess 18.

Seat ring 20 is generally annular in configuration and is adapted to be received in seat ring recess 17. Seat ring 20 includes a central opening 21 and an elastomeric seat ring 22. An o-ring 23 is provided to form a seal between the exterior of seat ring 20 and seat ring recess 17.

In order to prevent washing out of the interior of body 13 immediately below seat ring 20, seat ring 20 includes a downwardly depending annular skirt 24. It has been found that most of the washing of the interior of body 13 occurs immediately below seat ring 20. This washing is due to the turbulent flow in that region. Skirt 24 extends downwardly within body 13 past the area where severe washing occurs and thus it is skirt 24 and not body 13 that is subject to wear. When skirt 24 becomes excessively worn, seat ring 20 may be replaced. Seat ring 20 is held within body 13 by a snap ring 25 that is snapped into recess 18.

Piston 30 is axially movably disposed in body 13 below seat ring 20. Piston 30 includes an annular seating portion 31 that is adapted to seat against seat 22 of seat ring 20. Piston 30 includes a bore 32 coaxial with central opening 21 of seat ring 20. Bore 32 is normally occluded interior of seat 31 by a plug 33, which includes a shear ring 34 removably inserted in bore 32 and a spear 35 axially movably disposed within shear ring 34.

During operation, seating portion 31 is subject to some washing action, which after a time causes seating portion 31 to become rounded. Such rounding would tend to cause the valve to leak if a metal-to-metal seal were used between seat ring 20 and seating portion 31. However, the elastomeric seat of the present invention conforms to seating portion 31 and thereby increases the life of the valve.

Figure 2:
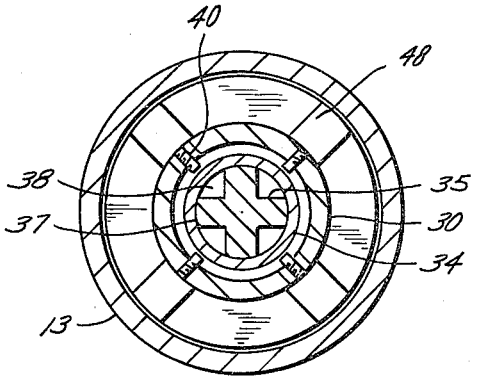
FIG. 2 is a section view taken along line 2—2 of FIG. 1.
Figure 3:
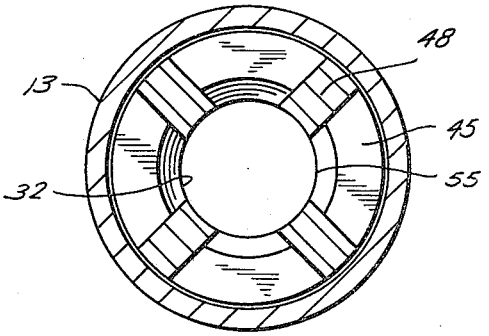
FIG. 3 is a section view taken along line 3—3 of FIG. 1.
Figure 4:
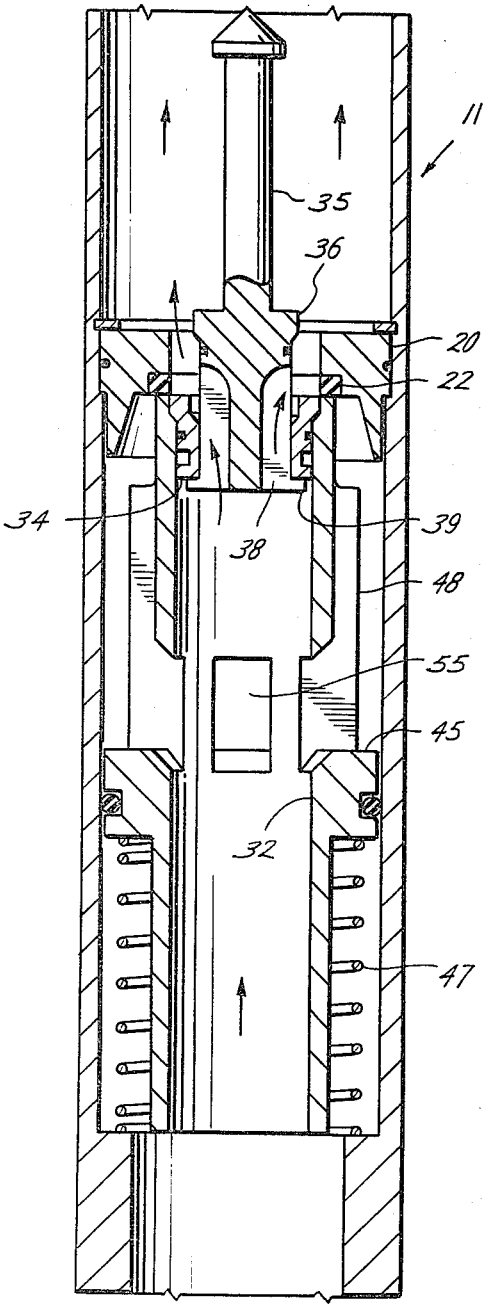
FIG. 4 is a section view of the mud saver valve of the present invention showing operation of the valve during back flow.

Spear 35 includes a circular upper portion 36 which normally forms a plug with shear ring 34. As is best illustrated in FIGS. 1 and 2, spear 35 also includes a lower portion 37 having an "X" shaped cross section which defines a plurality of flow passages 38. During back flow conditions, spear 35 is driven axially upwardly with respect to shear ring 34, as shown in FIG. 4, such that mud flows through flow passages 38 inside shear ring 34 and upwardly through central opening 21. The area of the flow passages 38 is substantial and allows significant back flow if downhole pressure exceeds the head in the kelly. The upward travel of spear 35 during back flow is limited by a plurality of feet 39 which extends radially outwardly to engage the bottom of shear ring 34.

Shear ring 34 is normally retained within bore 32 by a plurality of shear screws 40. If it is desired to remove plug 33 from bore 32, an overshot may be used to grasp spear 35 to apply an upward force to shear screws 40 and thereby remove shear ring 34 and spear 35. Such removal allows full access to bore 32 so that fishing tools may be run down the drill string. An upward force may be applied to spear 35 to shear screws 40.

Piston 30 includes a flange 45 which extends radially outwardly into sliding engagement with recess 16 of body 13. In order to form a seal between body 13 and flange 45, and o-ring 46 may be provided. Piston 45 is urged upwardly against seat 22 by a spring 47 pressed between flange 45 and body 13. Piston 30 is centralized within body 13 by plurality of circumferentially spaced apart stabilizer fins 48. Stabilizer fins 48 extend axially along and radially out from piston 30 and sliding contact with the interior of body 13. Stabilizer fins 48 function to maintain the axial alignment of bore 32 with central opening 21 of seat ring 20 as piston 30 moves axially upwardly and downwardly.

Figure 5:
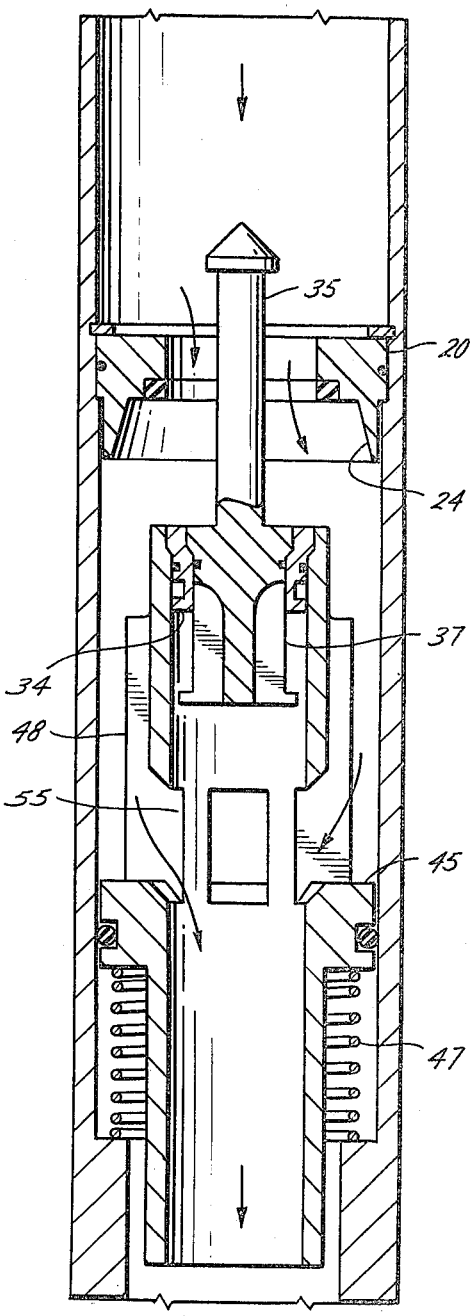
FIG. 5 is a section view of the mud saver valve of the present invention showing operation of the valve during normal flow.

In order to allow drilling mud to flow into bore 32, a plurality of ports 55 are provided. Ports 55 are located between stabilizer fins 48 and above flange 45. The pressure of the mud during drilling first moves seating portion 31 away from seat 22. The pressure then acts on flange 45 to drive piston 30 fully downwardly within body 13, as shown in FIG. 5, thus allowing the mud to flow smoothly and with a minimum of turbulence through the valve. The low turbulence of the mud decrease substantially the washing of the parts of the valve.

Further modifications and alternative embodiments of the apparatus of this invention will be apparent to those skilled in the art in view of this description. Accordingly, this description is to be construed as illustrative only and is for the purpose of teachings those skilled in the art the manner of carrying out the invention. It is to be understood that the form of the invention herewith shown and described is to be taken as the presently preferred embodiment. Various changes may be made in the shape, size, and arrangements of parts. For example, equivalent elements or materials may be substituted for those illustrated and described herein, parts may be reversed and certain features of the invention may be utilized independently of the use of other features, all as would be apparent to one skilled in the art after having the benefit of this description of the invention.

What is claimed is:

1. A mud saver valve, which comprises:

a tubular body connectable between the kelly and the drill string:

an annular seat ring mounted within said body, said seat ring having a central opening;

a piston axially movably disposed within said body for engagement with said seat ring, said piston having a bore substantially coaxially aligned with said central opening and a flange extending radially outwardly from said piston to slidingly engage the interior of said body, said piston having a port above said flange communicating the exterior of said piston with said bore;

a plug removably mounted in said piston above said port to normally close said bore, said plug including a shear ring removably inserted in said bore with a shear pin shearingly connecting said shear ring with said piston, and a spear axially movably mounted in said shear ring for movement between a first position wherein said spear sealingly engages said shear ring and a second position to allow fluid to flow upwardly between said spear and said shear ring;

and means for urging said piston into engagement with said seat ring.

2. The valve as claimed in claim 1, including means for stabilizing said piston within said body.

3. The valve as claimed in claim 2, wherein said stabilizing means includes a plurality of longitudinal fins extending radially outwardly from said piston to slidingly engage the interior of said body.

4. The valve as claimed in claim 1, wherein:

said shear ring includes central aperture;

and said spear includes a first portion sealingly engageable with said central aperture of said shear ring, a second portion below said first portion forming a flow passage between said spear and said central aperature, and means for limiting the upward travel of said spear with respect to said shear ring.

5. The valve as claimed in claim 1, wherein:

said shear ring includes upper cylindrical aperture and a lower cylindrical aperture having a diameter smaller than the diameter of said upper aperture, said upper and lower apertures being connected by a shoulder;

and said spear includes an upper cylindrical portion having a diameter substantially equal to the diameter of said upper portion of said shear ring, and lower cylindrical portion having a diameter substantially equal to the diameter of said lower portion of said shear ring, said upper and lower portions being connected by a shoulder engageable with said shoulder of said shear ring, said lower portion including a plurality of longitudinal grooves and a plurality of feet extending radially outwardly therefrom to limit the upward travel of said spear with respect to said shear ring.

6. The valve as claimed in claim 1, including an elastomeric seating surface mounted to seat ring and forming a seat with said piston.

7. The valve as claimed in claim 1, wherein said urging means includes a compression spring disposed between the lower side of said flange and an annular ledge in the interior of said body.

8. The valve as claimed in claim 1, wherein said spring is adapted to compress fully when mud is flowing downwardly through said valve.

9. The valve as claimed in claim 1, wherein said seat ring includes a downwardly depending skirt for preventing washing of said body.

10. A mud saver valve, which comprises:

a tubular body connectable between the kelly and the drill string;

an annular seat ring mounted within said body, said seat ring having a central opening;

a piston axially movably disposed within said body for engagement with said seat ring, said piston having a bore substantially coaxially aligned with said central opening and a flange extending radially outwardly from said piston to slidingly engage the interior of said body, said piston having a port above said flange communicating the exterior of said piston with said bore;

a plug removably mounted in said piston above said port to normally close said bore, said plug including a shear ring, removably inserted in said bore and a spear axially movably mounted in said shear ring for movement between a first position wherein said spear sealingly engages said shear ring and a second position to allow fluid to flow upwardly between said spear and said shear ring, said shear ring including a central aperture, and said spear including a first portion sealingly enageable with said central aperture of said shear ring, a second portion below said first portion forming a flow passage between said spear and said central aperture, and means for limiting the upward travel of said spear with respect to said shear ring;

and means for urging said piston into engagement with said seat ring.

* * * * *